US009200641B2

(12) United States Patent
Kampf

(10) Patent No.: US 9,200,641 B2
(45) Date of Patent: Dec. 1, 2015

(54) AXIAL FAN AND A METHOD OF MANUFACTURING A BLOWER PIPE THEREFOR

(75) Inventor: Lars Verner Kampf, Naestved (DK)

(73) Assignee: NOVENCO A/S, Naestved (DK)

( * ) Notice: Subject to any disclaimer, the term of this patent is extended or adjusted under 35 U.S.C. 154(b) by 480 days.

(21) Appl. No.: 13/498,785

(22) PCT Filed: Oct. 13, 2010

(86) PCT No.: PCT/DK2010/050265

§ 371 (c)(1), (2), (4) Date: May 4, 2012

(87) PCT Pub. No.: WO2011/044909

PCT Pub. Date: Apr. 21, 2011

(65) Prior Publication Data

US 2012/0219416 A1 Aug. 30, 2012

(30) Foreign Application Priority Data

Oct. 13, 2009 (DK) ..... 2009 01118

(51) Int. Cl.

*F04D 19/00* (2006.01)
*F04D 29/52* (2006.01)
*F04D 29/02* (2006.01)
(Continued)

(52) U.S. Cl.

CPC ..... *F04D 29/526* (2013.01); *F04D 29/023* (2013.01); *F04D 29/545* (2013.01); *F04D 29/646* (2013.01)

(58) Field of Classification Search

CPC ... F04D 29/023; F04D 29/526; F04D 29/545; F04D 29/646

USPC ..... 415/200, 218.1

See application file for complete search history.

(56) References Cited

U.S. PATENT DOCUMENTS 1,956,829 A * 5/1934 Frank ..... 415/150
2,925,216 A * 2/1960 Stalker ..... 415/220
(Continued)

FOREIGN PATENT DOCUMENTS

| | | |
|---|---|---|
| AU | 41293/72 | 10/1973 |
| DE | 24 43 754 | 3/1976 |
| GB | 2 276 208 A | 9/1994 |

OTHER PUBLICATIONS

May 26, 2010 Danish Search Report issued in Danish Patent Application No. PA 2009 01117 (with translation).
(Continued)

*Primary Examiner* — Igor Kershteyn
*Assistant Examiner* — Woody A Lee, Jr.
(74) *Attorney, Agent, or Firm* — Oliff PLC

(57) ABSTRACT

An axial fan comprising a circular-cylindrical blower pipe configured about a center axis and comprising one or more plates that are bent and subsequently joined at opposing plate rims for forming the circular-cylindrical blower pipe; and wherein the circular-cylindrical blower pipe has two opposing ends; wherein the blower pipe is, at both its ends, bent outwards at right angles to the outside of the blower pipe for forming a mounting flange. The blower pipe comprises a rust-resistant metal plate or a steel plate which is coated with a rust-resistant material at least on the outside and the inside of the blower pipe; and in that the plate rims are joined in a rim-by-rim manner, without overlap, by soldering or welding with a rust-resistant filler material.

10 Claims, 6 Drawing Sheets

Figure 1:
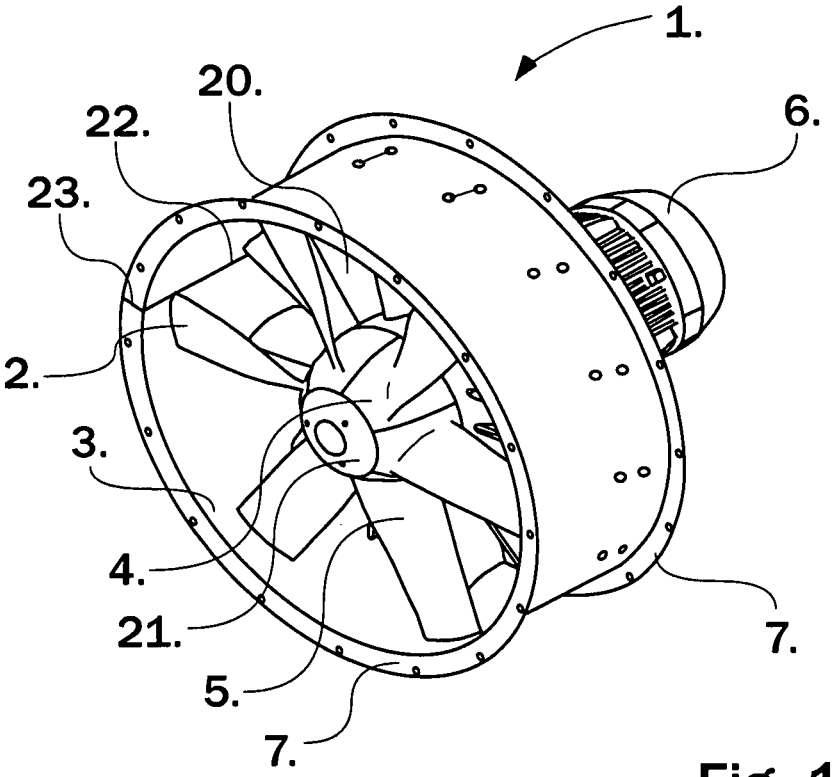

(51) Int. Cl.
*F04D 29/54* (2006.01)
*F04D 29/64* (2006.01)

(56) References Cited

U.S. PATENT DOCUMENTS 4,219,307 A 8/1980 Bergdahl
4,720,359 A * 1/1988 Glauz et al. ..... 261/24
5,519,192 A * 5/1996 Childs et al. ..... 219/616
5,575,622 A 11/1996 Zimmerman et al.
5,803,709 A 9/1998 Matthews et al.
5,816,781 A * 10/1998 Bercot et al. ..... 417/371
2009/0056929 A1 3/2009 Mulder

OTHER PUBLICATIONS

Mar. 24, 2011 International Search Report issued in International Patent Application No. PCT/DK2010/050265.

* cited by examiner

AXIAL FAN AND A METHOD OF MANUFACTURING A BLOWER PIPE THEREFOR

FIELD OF USE OF THE INVENTION

The present invention relates to an axial fan and a method of manufacturing a blower pipe for an axial fan of the type that comprises a blower pipe configured about a centre axis and being essentially circular-cylindrical, having an inner side and an outer side; and wherein the blower pipe is configured with a fan rotor, which fan rotor has a rotor shaft which essentially coincides with the centre axis of the blower pipe, and wherein blower pipe comprises one or more plates that are bent and subsequently joined at opposing plate rims for forming the circular-cylindrical blower pipe; and wherein the circular-cylindrical blower pipe has two opposing ends; wherein the blower pipe is, at least at its one end, bent outwards essentially at right angles to the outside of the blower pipe for forming a mounting flange on which means are provided for mounting of the axial fan in a tubing system.

STATE OF THE ART

Today several different embodiments of axial fans of the above-mentioned type are known, and they are generally used for being integrated into a tubing system, such as a ventilation system, where they serve the purpose of blowing air through the tubing system.

Thus, a large number of different embodiments of that type of fan are known, and it is a constant challenge in the development of such axial fans to achieve that the axial fan has high efficiency to the effect that, in given conditions and at a given motor power for driving the fan rotor, a high pressure increase is achieved and/or a high air throughput.

One method of achieving a high efficiency is thus to minimise the tip clearance defined by the distance between the outer diameter of the fan rotor and the surrounding blower pipe. On the one hand, it is desired that this tip clearance is as small as possible for the sake of optimising the efficiency, and, on the other hand, it must not be so small that, in practice, it may occur that the rotor blades hit the inside of the blower pipe.

OBJECT OF THE INVENTION

Based on that, it is the object of the present invention to provide an axial fan of the kind described above which, to a higher degree than known axial fans, enables a reduction of the tip clearance without this, all other things being equal, necessitating use of further constituent components to make sure that the rotor blades do not touch the blower pipe.

This is accomplished by means of an axial fan of the kind set forth above and which is characterised in that the plate or the plates comprised by the blower pipe comprises a rust-resistant metal plate or a steel plate which is coated with a rust-resistant material at least on the outside and the inside of the blower pipe; and in that the plate rims are joined in a rim-by-rim manner, without overlap, by soldering with a rust-resistant filler material.

Thereby it is accomplished that the plates and the soldering seam, and including in particular the plate rims that adjoin each other, are efficiently protected against corrosion to the effect that a subsequent rust-protecting treatment is rendered superfluous, which treatment may, eg in case of heat treatment in a galvanizing bath, cause the blower pipe to deform slightly. At the same time it is ensured that the formation of turbulence in the air flow around the soldering seam is minimised and that the required tip clearance around the soldering seam is reduced significantly to the effect that, all other things being equal, a considerable reduction of the required average tip clearance about the blower rotor is accomplished.

Moreover, it is accomplished that, by the soldering, it is possible to use lower melting temperatures than by welding to the effect that the risk of the blower pipe warping in the process is minimised.

According to a preferred embodiment the plate or the plates comprises/comprise steel plates that are galvanized on both sides.

Moreover, the opposing plate rims are further advantageously joined by soldering by use of a copper-based filler material.

In this context, the soldering seam advantageously extends at least into one of the mounting flanges; and the soldering seam in this mounting flange extends at least partially at an angle of five degrees or more relative to the radius of the blower pipe. Thereby it is accomplished that internal tensile stresses that are often present in the mounting flange do not occur at right angles to the soldering seam to the effect that the soldering seam is able to sustain a higher tensile stressing, all other things being equal.

In this relation it is expedient if the soldering seam, which extends at least into the one mounting flange, is zigzag-shaped whereby it extends, in a first section, the one way around the centre axis of the blower pipe and then, in another section, it extends the other way around the centre axis of the blower pipe. Thereby the soldering seam is further relieved.

According to a particularly preferred embodiment, the soldering seam is configured such that the plate rims can be locked geometrically to each other in the same plane in a manner similar to that of the pieces of a puzzle, following which the soldering primarily serves the purpose of keeping the plate rims in the same plane and hence in engagement with each other.

In situations when particularly high tensile stressing is anticipated in the mounting flange, a further relief of the soldering seam extending at least into one of the mounting flanges can be obtained in that, in proximity of the soldering seam, at least one recess is configured on the outermost edge of the mounting flange.

The invention also relates to a method of manufacturing an axial fan of the type set forth above, and whereby the plate or the plates comprised by the blower pipe is/are cut out of a rust-resistant metal plate or a steel plate which is coated with a rust-resistant material at least on the outside and the inside of the blower pipe, following which the plate or the plates is/are rolled until the plate rims meet, following which they are joined in a rim-by-rim manner, without overlap, by soldering with a rust-resistant filler material.

To that end, the plates may advantageously comprise zinc and/or aluminium-coated steel plate, and wherein the joining of the plate rims takes place by use of a copper-based filler material.

In this context each mounting flange may be configured by plastic deformation, such as flanging, of the ends of the blower pipe.

LIST OF FIGURES

FIG. 1: is a perspective view of an axial fan according to the present invention, seen in an inclined view from the front and from above.

Figure 2:
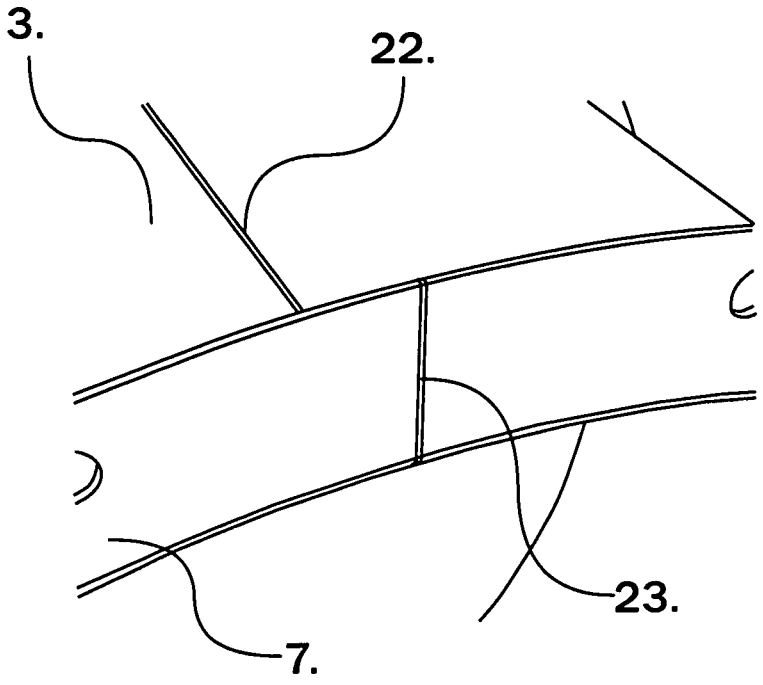

FIG. 2: shows a detail of the soldering seam of the axial fan shown in FIG. 1.

Figure 3:
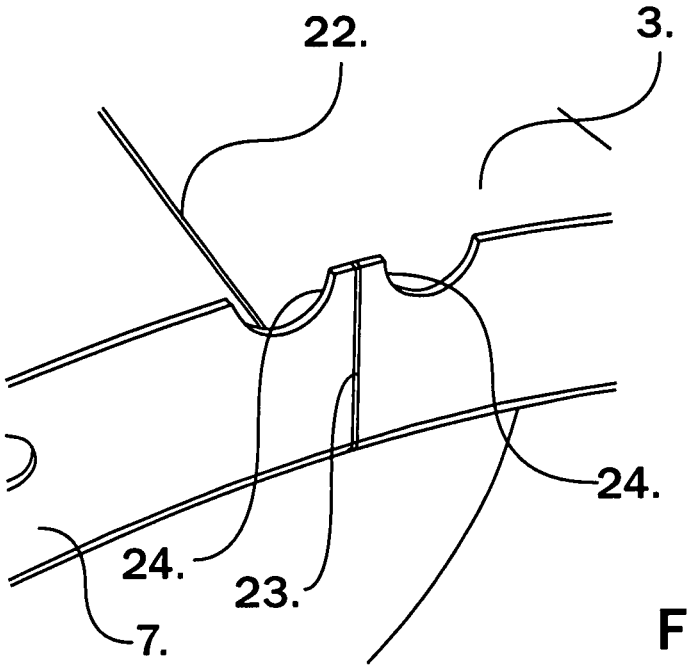

FIG. 3: shows an alternative embodiment of the soldering seam according to FIG. 2.

Figure 4:
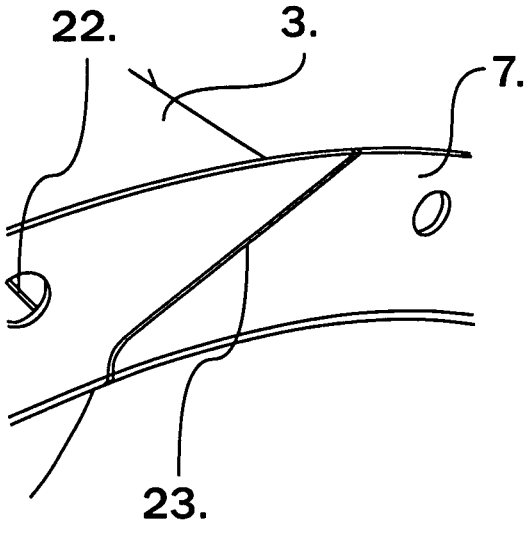

FIG. 4: shows a further alternative embodiment of the soldering seam according to FIG. 2.

Figure 5:
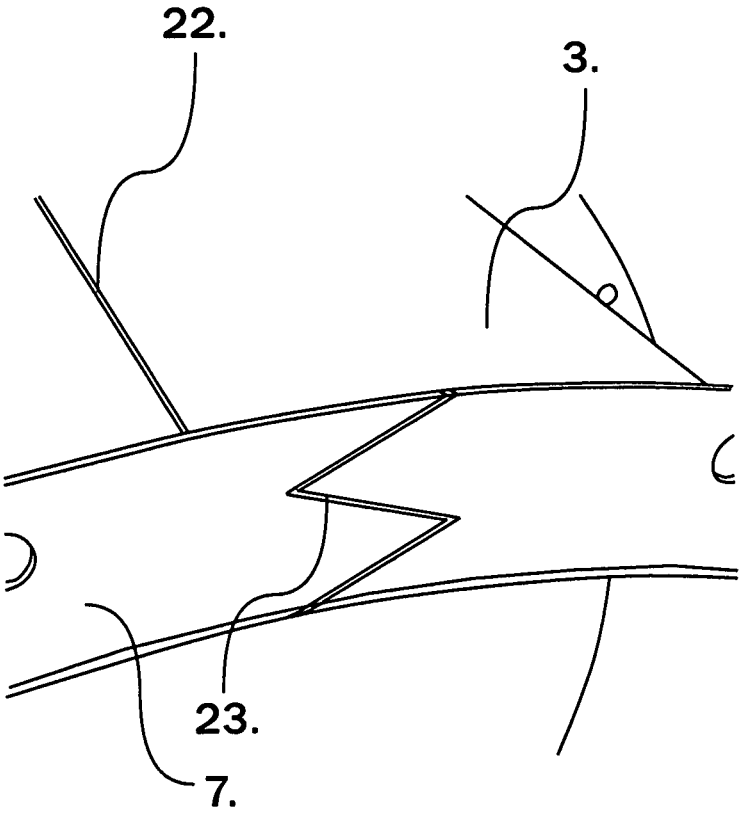

FIG. 5: shows a further alternative embodiment of the soldering seam according to FIG. 2.

Figure 6:
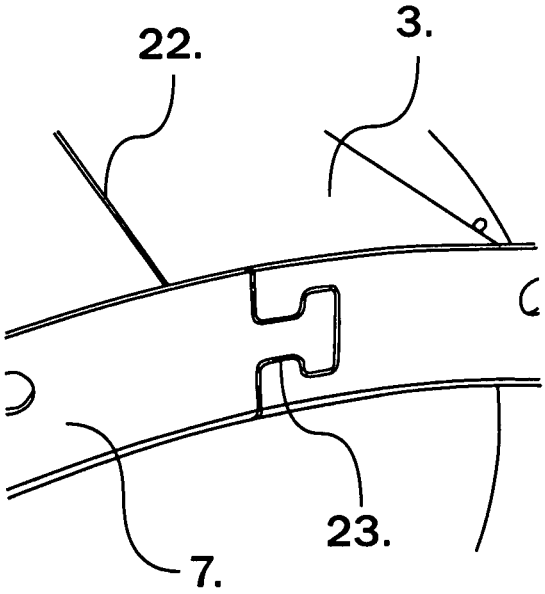

FIG. 6: shows a further alternative embodiment of the soldering seam according to FIG. 2.

EMBODIMENT OF THE INVENTION

Thus, FIG. 1 shows an axial fan 1 according to the present invention, said axial fan 1 having a fan rotor 2 in the form of a propeller which is driven by a motor 6, said fan rotor 2 having a rotor hub 4 which is mounted to a not shown rotor shaft which is driven by the motor 6 about the centre axis of the rotor 2.

The rotor 2 is located centrally in a blower pipe 3 which has, at both its ends, a mounting flange 7 extending outwards from the blower pipe 3 and being provided with bolt holes for mounting of the axial fan 1 in a tubing system, such as a ventilation tubing system, where it serves to propel air through the tubing system.

Moreover, the rotor 2 has a set of rotor blades 5 extending radially outwards from the rotor hub 4 and out towards the blower pipe 3 where the rotor blades 5 end a short distance from the inner side of the blower pipe 3 to the effect that the smallest possible tip clearance is established between the outermost end of the rotor blades 5 and the inner side of the blower pipe 3.

According to the invention, the blower pipe is configured from a rust-resistant plate material which is rolled and joined at its opposing rims and, without overlap, by the soldering seam 22. Mounting flanges 7 are configured by plastic processing of the rolled pipe to the effect that a section 23 of the soldering seam 22 extends into the mounting flanges 7. This is shown in detail in FIG. 2.

Obviously, this will entail a strain on the soldering seam 22 and in particular on the section 23 of the soldering seam 22 that extends into the mounting flanges.

Therefore, FIG. 3 shows an alternative embodiment wherein, in the outermost edge of the mounting flange 7 and to both sides of the soldering seam, a relief is provided in the form of a recess 24. Thereby the risk of the soldering seam 22, and in particular the section 23 thereof which extends into the mounting flange, being destroyed due to internal tensile stresses in the mounting flange around the soldering seam is reduced.

In this context, the person skilled in the art is obviously aware that the configuration of the recesses 24 shown in FIG. 2 can be made in other ways without departing from the fundamental principle, and including that, obviously, merely by use of one single recess on one side of the soldering seam, instead of the two recesses shown, a relief will also be accomplished.

Now, FIG. 3 shows a further alternative embodiment of the soldering seam according to FIG. 2, the section 23 on the soldering seam 22 extending here in an inclined manner relative to the radius of the blower pipe 3. Hereby tensile stresses extending along the diameter of the blower pipe 3 will not be at right angles to the welding or soldering seam, and therefore the soldering seam will, all other things being equal, be able to tolerate higher tensile stresses during formation of the mounting flange 7 in the manufacturing process, but also in operation of the axial fan.

According to a further, alternative embodiment the section 23 on the soldering seam 22 may extend in zigzag-shape to the effect that it extends alternately one way and the opposite way around the centre axis of the blower pipe. This will further stabilise the soldering seam against destruction during production and operation.

According to a further alternative embodiment, the soldering seam is configured such that the plate rims engage each other at least in the portion that constitutes the mounting flange 7. In this context, a part of the above-mentioned tensile stresses in the mounting flange 7 will be converted into compressive forces in a part of the soldering seam, and hence a further stable soldering of the plate rims will be established, since a larger part of the tensile stresses can be taken up by the plates rather than by the soldering seam.

The invention claimed is:

1. An axial fan comprising:

a circular-cylindrical blower pipe configured about a center axis and having an inner side and an outer side, wherein:

the blower pipe is configured with a fan rotor, the fan rotor has a rotor shaft that coincides with the center axis of the circular-cylindrical blower pipe, the blower pipe comprises at least one plate that is bent and subsequently joined at opposing plate rims for forming the circular-cylindrical blower pipe, the blower pipe has two opposing ends, the blower pipe is, at least at its one end, bent outwards at right angles to the outside of the blower pipe for forming a mounting flange on which means are provided for mounting of the axial fan in a tubing system, the at least one plate comprises a rust-resistant metal plate at least on the outside and the inside of the blower pipe, and the opposed plate rims extend along a same plane, and are joined in a rim-by-rim manner, without overlap, by soldering with a rust-resistant filler material.

2. An axial fan according to claim 1, wherein the plate or the plates comprises/comprise steel plates that are galvanised on both sides.

3. An axial fan according to claim 2, wherein the opposing plate rims are joined by soldering by means of a copper- or aluminium-based filler material.

4. An axial fan according to claim 1, wherein a soldering seam extends at least into one of the mounting flanges; and that the soldering seam in this mounting flange extends at least partially at an angle of 5 degrees or more relative to the radius of the blower pipe.

5. An axial fan according to claim 4, wherein the part of the soldering seam which extends into one of the mounting flanges is zigzag-shaped.

6. An axial fan according to claim 1, wherein the soldering seam is configured such that the plate rims engage with each other at least in the part that constitutes the mounting flange.

7. An axial fan according to claim 1, wherein the soldering seam extends at least partially into one of the mounting flanges; and in that, in proximity of the soldering seam, at least one recess is configured on the outermost edge of the mounting flange.

8. A method of manufacturing an axial fan comprising the steps of:

providing a circular-cylindrical blower pipe configured about a centre axis and having an inner side and an outer side;

configuring the blower pipe with a fan rotor, providing the fan rotor with a rotor shaft that coincides with the centre axis of the blower pipe;

providing the blower pipe with at least one plate, bending and joining the at least one plate at opposing plate rims for forming the circular-cylindrical blower pipe, the blower pipe having two opposing ends, bending the blower pipe at both its ends outwards at right angles to the outside of the blower pipe for forming a mounting flange on which means are provided for mounting of the axial fan in a tubing system, cutting the at least one plate out of a rust-resistant metal plate at least on the outside and the inside of the blower pipe, after cutting the at least one plate, rolling the at least one plate until the plate rims meet, and after rolling the at least one plate, joining the at least one plate in a rim-by-rim manner, without overlap, by soldering with a rust-resistant filler material.

9. A method according to claim 8, wherein the plates comprise zinc and/or aluminium-coated steel plate; and that the joining of the plate rims takes place by use of a copper-based filler material.

10. An axial fan according to claim 9, wherein each mounting flange is configured by plastic deformation, such as flanging, of the ends of the blower pipe.

* * * * *